US011047387B2

(12) United States Patent
Wu et al.

(10) Patent No.: US 11,047,387 B2
(45) Date of Patent: Jun. 29, 2021

(54) ROTOR FOR A COMPRESSOR

(71) Applicant: Johnson Controls Technology Company, Auburn Hills, MI (US)

(72) Inventors: Tianshi Wu, St Francis, WI (US); Jian Xu, Wuxi (CN); John Lloyd Neel, Fairfield, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 272 days.

(21) Appl. No.: 16/143,275

(22) Filed: Sep. 26, 2018

(65) Prior Publication Data

US 2019/0093655 A1 Mar. 28, 2019

Related U.S. Application Data

(60) Provisional application No. 62/563,793, filed on Sep. 27, 2017.

(51) Int. Cl.

| | |
|---|---|
| ***F04C 18/16*** | (2006.01) |
| ***F04C 18/08*** | (2006.01) |
| ***F04C 29/04*** | (2006.01) |

(52) U.S. Cl.

CPC ..... *F04C 18/16* (2013.01); *F04C 18/084* (2013.01); *F04C 29/04* (2013.01); *F04C 2230/22* (2013.01); *F04C 2230/90* (2013.01); *F04C 2240/20* (2013.01)

(58) Field of Classification Search

CPC ..... F04C 18/084; F04C 18/16; F04C 2240/20

See application file for complete search history.

(56) References Cited

U.S. PATENT DOCUMENTS

| | | | | |
|---|---|---|---|---|
| 2,325,617 | A | 8/1943 | Lysholm et al. | |
| 2,801,792 | A * | 8/1957 | Lindhagen | F04C 18/084 418/94 |
| 3,424,373 | A | 1/1969 | Gardner | |
| 3,922,114 | A * | 11/1975 | Hamilton | F04C 29/045 417/366 |
| 3,938,915 | A | 2/1976 | Olofsson | |
| 3,947,163 | A | 3/1976 | Olofsson | |
| 5,772,418 | A | 6/1998 | Tateno et al. | |
| 9,683,569 | B2 * | 6/2017 | Collins | F04C 18/16 |
| 10,514,036 | B2 * | 12/2019 | Brown | F04C 18/16 |
| 2010/0072845 | A1 * | 3/2010 | Jung | G01M 13/045 310/90.5 |
| 2015/0118093 | A1 * | 4/2015 | Steffens | F04C 18/084 418/91 |

* cited by examiner

*Primary Examiner* — Mary Davis

(74) *Attorney, Agent, or Firm* — Fletcher Yoder, P.C.

(57) ABSTRACT

A system includes a compressor configured to compress a vapor, or a vapor and liquid mixture, and a first rotor of the compressor disposed on a first shaft, where the first rotor includes a first plurality of pockets in a first body portion to form a first semi-hollow internal volume or a plurality of flanks and/or a first plurality of flutes on a first external surface of the first rotor, where the plurality of flanks or the first plurality of flutes comprises a first pitch to form first variable leads.

20 Claims, 4 Drawing Sheets

ROTOR FOR A COMPRESSOR

CROSS REFERENCE TO RELATED APPLICATIONS

This application claims priority from and the benefit of U.S. Provisional Application Ser. No. 62/563,793, entitled "ROTOR FOR A COMPRESSOR," filed Sep. 27, 2017, which is hereby incorporated by reference in its entirety for all purposes.

BACKGROUND

The present disclosure relates generally to compressors, and more particularly, to screw compressors for heating, ventilating, air conditioning, and refrigeration (HVAC&R) systems, fuel gas boosting systems, air compression, and process gas compressions systems.

Heating, ventilating, air conditioning, and refrigeration (HVAC&R) systems typically maintain temperature control in a structure by circulating a refrigerant through a conduit to exchange thermal energy with another fluid. A compressor of the system receives a cool, low pressure vapor, or vapor and liquid mixture, and by virtue of compression, exhausts a hot, high pressure vapor, or vapor and liquid mixture. One type of compressor is a screw compressor, which generally includes one or more cylindrical rotors mounted on separate shafts inside a hollow casing. Twin screw compressor rotors typically have helically extending lobes (or flanks) and grooves (or flutes) on their outer surfaces forming a thread on the circumference of the rotor. During operation, the threads of the rotors mesh together, with the lobes on one rotor meshing with the corresponding grooves on the other rotor to form a series of gaps between the rotors. The gaps form a continuous compression chamber that communicates with the compressor inlet opening, or "port," at one end of the casing and continuously reduces in volume as the rotors turn to compress the gas toward a discharge port at the opposite end of the casing. Existing screw compressor rotors are formed from a solid piece of material, and thus, are relatively costly and heavy, which may add cost and weight to the compressor. Additionally, the increased mass causes individual rotors to have a reduced natural frequency, which may lead to increased vibrations during compressor operation and reduce performance of the compressor.

SUMMARY

In one embodiment, a system includes a compressor configured to compress a vapor, or vapor and liquid mixture, and a first rotor of the compressor disposed on a first shaft, where the first rotor includes a first plurality of pockets in a first body portion to form a first semi-hollow internal volume.

In another embodiment, a system includes a compressor configured to compress a vapor, or vapor and liquid mixture, and a first rotor of the compressor disposed on a first shaft, where the first rotor includes a plurality of flanks and a plurality of flutes on a first external surface of the first rotor, where the plurality of flanks and the plurality of flutes have a first pitch to form first variable leads and where the first rotor includes a first plurality of pockets in a first body portion to form a first semi-hollow internal volume of the first rotor.

In an another embodiment, a method includes forming a first rotor using an additive manufacturing technique, where the first rotor includes a first plurality of pockets within a first body portion, or first variable leads, or both, and forming a second rotor using the additive manufacturing technique, where the second rotor includes a second plurality of pockets within a second body portion, or second variable leads, or both.

DRAWINGS

DETAILED DESCRIPTION

Figure 1:
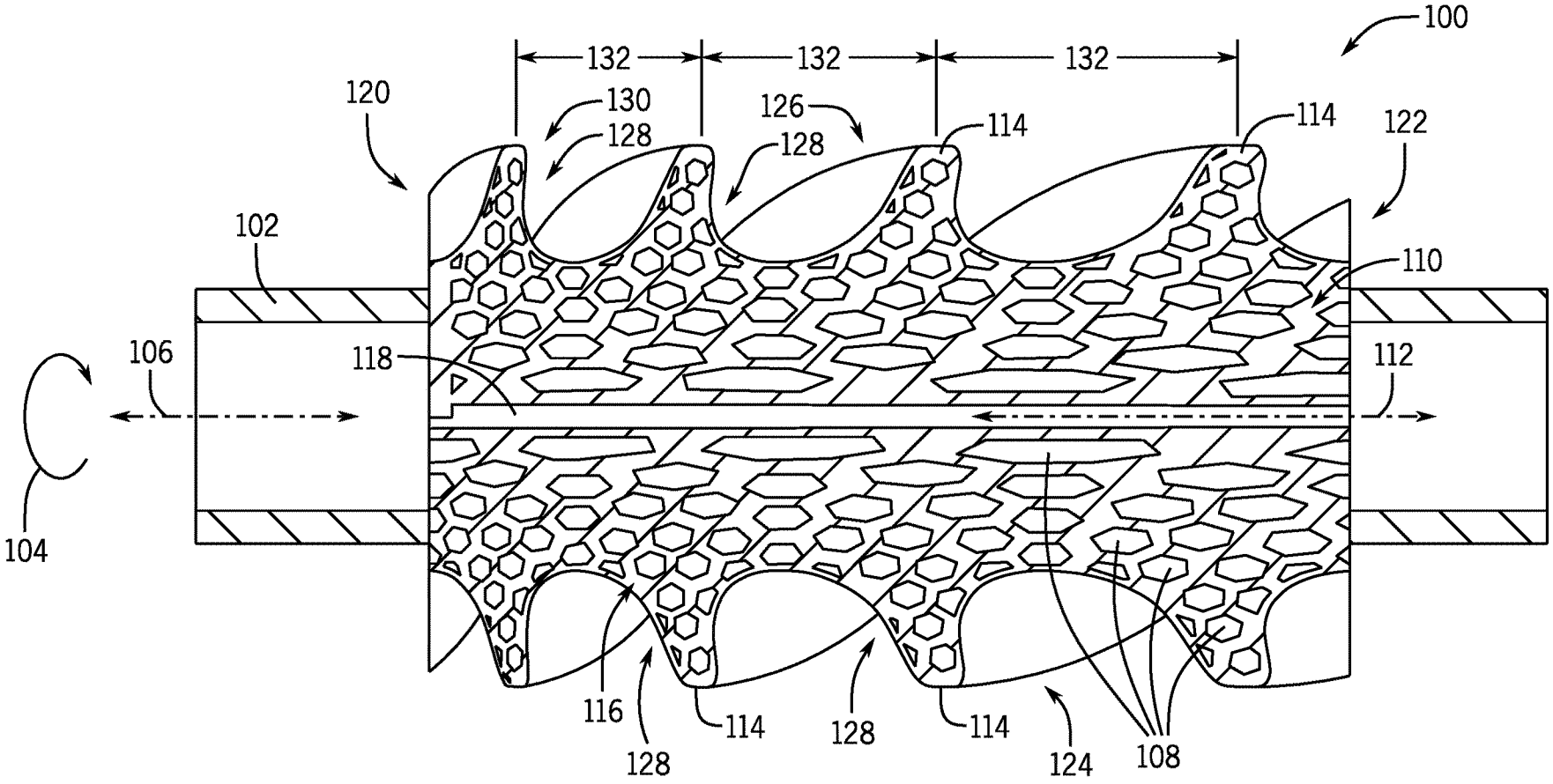
FIG. 1 is a cross-section of an embodiment of a first rotor of a compressor that may be included in a vapor compression system, in accordance with an aspect of the present disclosure.

Embodiments of the present disclosure are directed toward improved rotors for a screw compressor and methods for manufacturing such rotors. Existing screw compressors generally include one or more rotors formed from a solid material, thereby increasing a mass of the rotors. Rotors may incur vibration during operation of the compressor. In some cases, the vibration of solid rotors may reach a natural frequency, or a frequency that is substantially the same as a frequency of vibrations caused by pulsations of vapor (or another fluid) flowing through the compressor. Rotors that vibrate at the natural frequency may disrupt operation of the screw compressor, thereby leading to reduced performance, reliability, and/or durability of the compressor.

Embodiments of the present disclosure are directed to semi-hollow (or hollow) rotors that include a reduced mass when compared to existing rotors, but include substantially the same stiffness as solid rotors. As described in detail below, embodiments of the rotors include a honeycomb, webbed, or gyroid structure (e.g., internal volume) that may include pockets, gaps, or voids that do not include solid material. The semi-hollow (or hollow) rotors include less material than solid rotors, and thus may reduce capital costs of the compressor. Moreover, reducing the mass of the rotor increases a natural frequency of the rotor, and in some cases, increases the natural frequency above (or below) an excitation frequency of the compressor. In other words, a frequency of a lateral critical speed of semi-hollow (or hollow) rotors is greater than the frequency of the lateral critical speed of a solid rotor, which may facilitate adjustment of the natural frequency of rotor. For example, the natural frequency of the semi-hollow (or hollow) rotors may be adjusted or tuned based on a lobe passing frequency and/or a first harmonic of the lobe passing frequency of the semi-hollow (or hollow) rotors to reduce vibrations during operation of the compressor. Accordingly, the natural frequency of the semi-hollow (or hollow) rotors is adjusted to avoid excitation frequencies of the compressor. Therefore, disruptions to the operation of the compressor caused by vibrations may be eliminated or reduced by utilizing semi-hollow or hollow rotors. Additionally, reducing the mass of the rotors may enable the compressor to operate over a greater range of operating speeds when compared to existing solid rotors.

In some cases, rotors of the present disclosure are manufactured utilizing an additive manufacturing technique, such as three-dimensional (3-D) printing. The additive manufacturing techniques facilitate manufacturing of the rotors with the honeycomb, or webbed, structure (e.g., internal volume) because such techniques do not form the rotor from a solid piece of material. In other words, additive manufacturing techniques may create an object layer-by-layer until the final structure is achieved. Conversely, existing rotors are machined from a solid piece of material to create the final structure. Therefore, additive manufacturing techniques enable complex internal structures, such as honeycomb or webbed structures, to be formed quickly and efficiently.

In addition to having a semi-hollow or hollow structure (e.g., internal volume), some embodiments of the present disclosure are directed to variable lead rotors. As used herein, a variable lead rotor (e.g., a rotor having variable leads) is a rotor that includes varying helix lead and/or pitch of threads disposed along an axial length of the rotor. Variable lead rotors may increase a rate of compression of the screw compressor by increasing a helix lead and/or pitch of the rotor from an inlet of the screw compressor to the outlet of the screw compressor. Moreover, transitions between different helix leads and/or pitches of the variable lead rotor may be smooth as a result of utilizing additive manufacturing techniques for generating the variable lead rotors. As such, the use of additive manufacturing to form rotors of a screw compressor enable relatively simple manufacture of rotors having a semi-hollow or hollow structure (e.g., internal volume), as well as variable lead rotors. While the present discussion focuses on a twin screw compressor having two rotors, it should be recognized that embodiments of the rotors described herein may be utilized in any screw compressor having any suitable number of rotors (e.g., one, two, three, four, five, six, seven, eight, nine, ten, or more than ten rotors).

Existing compressors of HVAC&R systems may include screw compressors that have solid rotors, which are relatively heavy. Embodiments of the present disclosure are directed to semi-hollow (or hollow) rotors for a screw compressor, which include a reduced mass compared to existing solid rotors. As such, semi-hollow rotors have an increased resonant frequency, which may reduce or eliminate disruption of compressor operation caused by vibrations of the rotor. In some embodiments, additive manufacturing techniques, such as three-dimensional (3-D) printing, are utilized to facilitate manufacturing of the semi-hollow (or hollow) rotors. Further, utilizing additive manufacturing techniques may enable the rotors to be variable lead rotors. As set forth above, variable lead rotors may enhance a compression rate of screw compressors, which may enhance the efficiency of the compressor and/or the overall HVAC&R system. Additionally, variable lead rotors reduce contact forces between adjacent rotors and/or reduce stress experienced by the rotors, thereby reducing wear and prolonging an operating life of the rotors. While the present discussion focuses on a screw compressor that includes female and male rotors, it should also be noted that embodiments of the rotors disclosed herein may also apply to screw compressors that include one or more gate rotors. Further, the embodiments of the present disclosure may also apply to screw compressors having twin rotors, or rotors that are disposed side-by-side, in addition to or in lieu of, rotors that are disposed above-and-below one another.

For example, FIG. 1 is a cross-section of an embodiment of a female rotor 100 (e.g., a first rotor) that includes a semi-hollow (or hollow) structure (e.g., internal volume). As shown in the illustrated embodiment, the female rotor 100 is formed on a shaft 102. In some embodiments, the female rotor 100 and the shaft 102 are a single-piece, unitary component. In other embodiments, the female rotor 100 is coupled to the shaft 102 via welding, a coupling device (e.g., a flange), and/or another suitable technique. The shaft 102 is coupled to an actuator (e.g., motor, a turbine, or an expansion device) of a compressor, which drives rotation of the shaft 102. Rotation of the shaft 102 causes the female rotor 100 to rotate in a first circumferential direction 104. In some embodiments, the actuator is directly coupled to the shaft 102. In other embodiments, the actuator is directly coupled to a shaft of a male rotor (see, e.g., FIG. 2), but not to the shaft 102 of the female rotor 100. In such embodiments, rotation of the female rotor 100 is driven by rotation of the male rotor, and thus, indirectly by the actuator. As such, a transfer torque applied to the shaft 102 is reduced, thereby reducing contact stresses between the female rotor 100 and the male rotor. Further, rotation of the female rotor 102 (and/or the male rotor) may be driven by timing gears that are included on each rotor to rotate the female rotor 102 (and/or the male rotor) at a predetermined rate (e.g., rotations per minute). In some embodiments, the shaft 102 is semi-hollow (or hollow) or annular, such that an opening is formed within the shaft 102 along an axial direction 106. In other embodiments, the shaft 102 is a solid cylinder.

As shown in the illustrated embodiment of FIG. 1, the female rotor 100 includes a plurality of pockets 108 (e.g., closed voids or gaps) within a body portion 110 of the female rotor 100. The plurality of pockets 108 do not include solid material (e.g., a metallic material), and in some embodiments, include air, another suitable gas, and/or may be depressurized to form a vacuum. In any case, the pockets 108 reduce the mass of the female rotor 100 by decreasing an amount of material included in the female rotor 100. In some embodiments, the pockets 108 extend circumferentially, or otherwise, through the female rotor 100 and/or around the shaft 102. In other words, the pockets 108 may include annular passageways forming a honeycomb-like or gyroid pattern within the body portion 110 of the female rotor 100. Further, the pockets 108 may include a cross-sectional shape in the form of a triangle, a square, a rectangle, a pentagon, a hexagon, a heptagon, an octagon, another suitable polygonal shape, or a combination thereof. In other embodiments, the pockets 108 may form another suitable pattern throughout the body portion 110 of the female rotor 100 that reduces a weight of the female rotor 100 and enables the female rotor 100 to have a predetermined stiffness. The stiffness of the female rotor is discussed in further detail below. In still further embodiments, the pockets 108 may be randomly spaced throughout the body portion 110 of the female rotor 100 and include various sizes, shapes, lengths, widths, and/or depths within the body portion 110. Including the pockets 108 in the female rotor 100 reduces a weight of the female rotor 100, but enables the female rotor 100 to include substantially the same (e.g., within 10% of, within 5% of, or within 1% of) stiffness as a rotor formed from a solid material (e.g., a rotor without the pockets 108).

As shown in the illustrated embodiment of FIG. 1, the pockets 108 include a reduced cross-sectional area when moving from a central axis 112 of the female rotor 100 towards flanks 114 positioned on an outer surface 116 of the female rotor 100. However, in other embodiments, the pockets 108 include substantially the same (e.g., within 10% of, within 5% of, or within 1% of) cross-sectional area throughout the body portion 110 of the female rotor 100.

Further, in some embodiments, the female rotor 100 includes a central passage 118 that extends along the central axis 112 of the female rotor 100. The central passage 118 may be an annular passage that extends from a first end 120 of the female rotor 100 to a second end 122 of the female rotor. In other embodiments, the female rotor 100 does not include the central passage 118, but instead includes additional pockets 108 disposed along the central axis 112 of the female rotor 100.

As discussed above, utilizing additive manufacturing techniques facilitates the formation of the female rotor 100 having the pockets 108 (e.g., a semi-hollow or hollow structure). For example, additive manufacturing techniques such as direct metal laser sintering (DMLS), laser-ultrasonic finishing, ultrasonic nanocrystal surface modification, selective laser sintering (SLS), selective laser melting (SLM), electronic beam melting (EBM), and/or another suitable technique may create the female rotor 100 in layers from the first end 120 to the second end 122 of the female rotor 100 or from a bottom portion 124 to a top portion 126 of the female rotor 100. In other embodiments, the female rotor 100 is constructed using the additive manufacturing technique in layers from a first end of the rotor 102 to a second end of the rotor 102. As such, the pockets 108 are formed within the body portion 110 of the female rotor 100 as the female rotor 100 is produced or created. In some embodiments, the female rotor 100 may incur further processing or machining (e.g., grinding or chemical etching) after formation via a suitable additive manufacturing technique. In existing systems, a rotor may be formed from a solid piece of material. Accordingly, forming the pockets 108 (e.g., closed gaps and/or voids) within the solid structure is time consuming, expensive, and complex.

Additionally, forming the female rotor 100 using additive manufacturing techniques enables the female rotor 100 to include variable leads. For example, as shown in the illustrated embodiment of FIG. 1, the female rotor 100 includes the flanks 114 and corresponding flutes 128 between adjacent flanks 114. The flanks 114 and the corresponding flutes 128 form threads 130 along the central axis 112 of the female rotor 100. The flanks 114 of the female rotor 100 become closer to one another when moving along the central axis 112 from the second end 122 to the first end 120 of the female rotor 100. In other words, a width of the corresponding flutes 128 decreases moving along the central axis 112 from the second end 122 to the first end 120 of the female rotor 100. As such, the female rotor 100 includes continuously variable leads where a helix lead and/or pitch of the flanks 114 continuously decreases along the central axis 112 from the second end 122 to the first end 120. In other embodiments, the flanks 114 of the female rotor 100 may be spaced further apart from one another when moving along the central axis 112 from the second end 122 to the first end 120 of the female rotor 100. In still further embodiments, the flanks 114 of the female rotor 100 may become closer to one another (or further apart from one another) for a predetermined distance along the central axis 112 from the second end 122 toward the first end 120 and then become spaced further apart from one another (or closer to one another) for a second predetermined distance along the central axis 112 from the second end 122 toward the first end 120. In such embodiments, the flanks 114 are spaced closest to one another (or furthest from one another) in a central portion of the female rotor 100 (e.g., at approximately a halfway point along the central axis 112 between the first end 120 and the second end 122).

As discussed above, a distance 132 between the flanks 114 and/or the width of the corresponding flutes 128, which may be referred to as a helix lead and/or pitch of the threads 130, varies along the central axis 112 of the female rotor 100 to form the variable leads of the female rotor 100. For example, the distance 132 at the second end 122 may be between two and three times larger than the distance 132 at the first end 120. The variable leads adjust a compression rate of the compressor and, in some embodiments, increase the compression rate of the compressor, thereby increasing an efficiency of the compressor.

Forming variable leads in existing rotors is relatively time consuming because the variable leads are machined into a solid piece of material. Utilizing additive manufacturing techniques facilitates formation of the variable leads and improves (e.g., smooths) transitions between the changes in the helix lead and/or pitch. For example, existing variable lead rotors include distinct transition points at locations along the rotor where the helix lead and/or pitch changes. Utilizing additive manufacturing enables variable leads to be formed with improved accuracy and reduces and/or eliminates transitions along the rotor where the helix lead and/or pitch changes.

Figure 2:
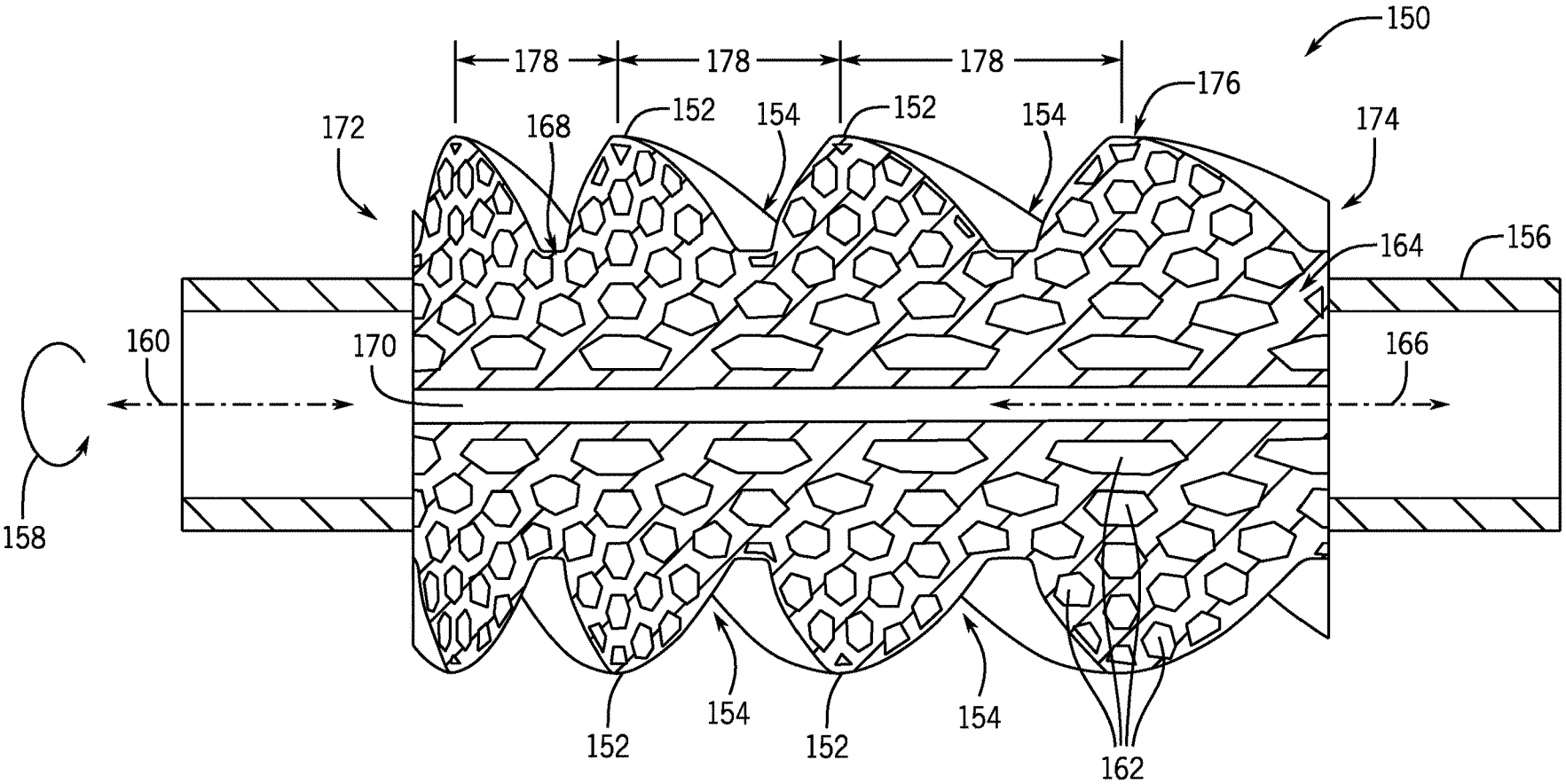
FIG. 2 is a cross-section of an embodiment of a second rotor of the compressor that may be included in the vapor compression system, in accordance with an aspect the present disclosure.

FIG. 2 is a cross-section of an embodiment of a male rotor 150 (e.g., a second rotor) that is configured to mesh with the female rotor 100 (e.g., see FIG. 1) to compress vapor, or a vapor and liquid mixture, within the compressor. For example, the male rotor 150 includes lobes 152 that are configured to be disposed in the flutes 128 of the female rotor 100. Further, the male rotor 150 includes grooves 154 that are configured to receive the flanks 114 of the female rotor 100. As shown in the illustrated embodiment of FIG. 2, the male rotor 150 is formed on a shaft 156 (e.g., a second shaft). In some embodiments, the male rotor 150 and the shaft 156 are a single-piece, unitary component. In other embodiments, the male rotor 150 is coupled to the shaft 156 via welding, a coupling device (e.g., a flange), and/or another suitable technique. As discussed above, the shaft 156 may be coupled to an actuator (e.g., motor, a turbine, or an expansion device) of the compressor, which drives rotation of the shaft 156. Rotation of the shaft 156 causes the male rotor 150 to rotate in a second circumferential direction 158, opposite the first circumferential direction 104, such that the female rotor 100 and the male rotor 150 mesh with one another and compress the vapor, or vapor and liquid mixture, flowing through the compressor. In some embodiments, the actuator is directly coupled to the shaft 156, but not to the shaft 102. In such embodiments, rotation of the female rotor 100 is driven by rotation of the male rotor 150, and thus, indirectly by the actuator. As such, a transfer torque applied to the shaft 102 is reduced, thereby reducing contact stresses between the female rotor 100 and the male rotor 150. Further, rotation of the male rotor 150 (and/or the female rotor 102) may be driven by timing gears that are included on each rotor to rotate the male rotor 150 (and/or the female rotor 102) at a predetermined rate (e.g., rotations per minute). In some embodiments, the shaft 156 is semi-hollow (or hollow) or annular, such that an opening is formed within the shaft 156 along an axial direction 160. In other embodiments, the shaft 156 is a solid cylinder.

As shown in the illustrated embodiment of FIG. 2, the male rotor 150 includes a plurality of pockets 162, which may be similar to the pockets 108 of the female rotor. For example, the plurality of pockets 162 do not include solid material (e.g., a metallic material), and in some embodiments, include air, another suitable gas, and/or may be depressurized to form a vacuum. In any case, the pockets 162 reduce the mass of the male rotor 150 by decreasing an amount of material included in the male rotor 150. In some embodiments, the pockets 162 extend circumferentially, or otherwise, through the male rotor 150 and/or around the shaft 156. In other words, the pockets 162 may include annular passageways forming a honeycomb-like or gyroid pattern within a body portion 164 of the male rotor 150. Further, the pockets 162 may include a cross-sectional shape in the form of a triangle, a square, a rectangle, a pentagon, a hexagon, a heptagon, an octagon, another suitable polygonal shape, or a combination thereof. In other embodiments, the pockets 162 may form another suitable pattern throughout the body portion 164 of the male rotor 150 that reduces a mass of the male rotor 150 and enables the male rotor 150 to include a predetermined stiffness. In still further embodiments, the pockets 162 may be randomly spaced throughout the body portion 164 of the male rotor 150 and include various sizes, shapes, lengths, widths, and/or depths within the body portion 164. As discussed above, including the pockets 162 in the male rotor 150 reduces a mass of the male rotor 150, but enables the male rotor 150 to include substantially the same (e.g., within 10% of, within 5% of, or within 1% of) stiffness as a rotor formed from a solid material (e.g., a rotor without the pockets 162).

As shown in the illustrated embodiment of FIG. 2, the pockets 162 include a constant or varied cross-sectional area when moving from a central axis 166 of the male rotor 150 towards the lobes 152 positioned on an outer surface 168 of the male rotor 150. However, in other embodiments, the pockets 162 include substantially the same (e.g., within 10% of, within 5% of, or within 1% of) cross-sectional area throughout the body portion 164 of the male rotor 150. Further, in some embodiments, the male rotor 150 includes a central passage 170 that extends along the central axis 166 of the male rotor 150. The central passage 170 may be an annular passage that extends from a first end 172 of the male rotor 150 to a second end 174 of the male rotor 150. In other embodiments, the male rotor 150 does not include the central passage 170, but instead includes additional pockets 162 disposed along the central axis 166.

Additionally, the lobes 152 and the grooves 154 form threads 176 along the central axis 166 of the male rotor 150. A distance 178 between the lobes 152 of the male rotor 150 become closer to one another when moving along the central axis 166 from the second end 174 to the first end 172 of the male rotor 150. In other words, a width of the grooves 154 decreases moving along the central axis 166 from the second end 174 to the first end 172 of the male rotor 150. As such, the male rotor 150 includes continuously variable leads where a helix lead and/or pitch of the lobes 152 continuously increases along the central axis 166 from the second end 174 to the first end 172. In other embodiments, the lobes 152 of the male rotor 150 may be spaced further apart from one another when moving along the central axis 166 from the second end 174 to the first end 172 of the male rotor 150. In still further embodiments, the lobes 152 of the male rotor 150 may become closer to one another (or further apart from one another) for a predetermined distance along the central axis 166 from the second end 174 toward the first end 172 and then become spaced further apart from one another (or closer to one another) for a second predetermined distance along the central axis 166 from the second end 174 toward the first end 172. In such embodiments, the lobes 152 are spaced closest to one another (or furthest from one another) in a central portion of the male rotor 150 (e.g., at approximately a halfway point along the central axis 166 between the first end 172 and the second end 174).

As discussed above, the distance between the lobes 152 and/or the width of the grooves 154, which may be referred to as a helix lead and/or pitch of the threads 176, varies along the central axis 166 of the male rotor 150 to form the variable leads of the male rotor 150. For example, the distance at the second end 174 may be between two and three times larger than the distance at the first end 172. The variable leads adjust a compression rate of the compressor and, in some embodiments, increase the compression rate of the compressor, thereby increasing an efficiency of the compressor.

Figure 3:
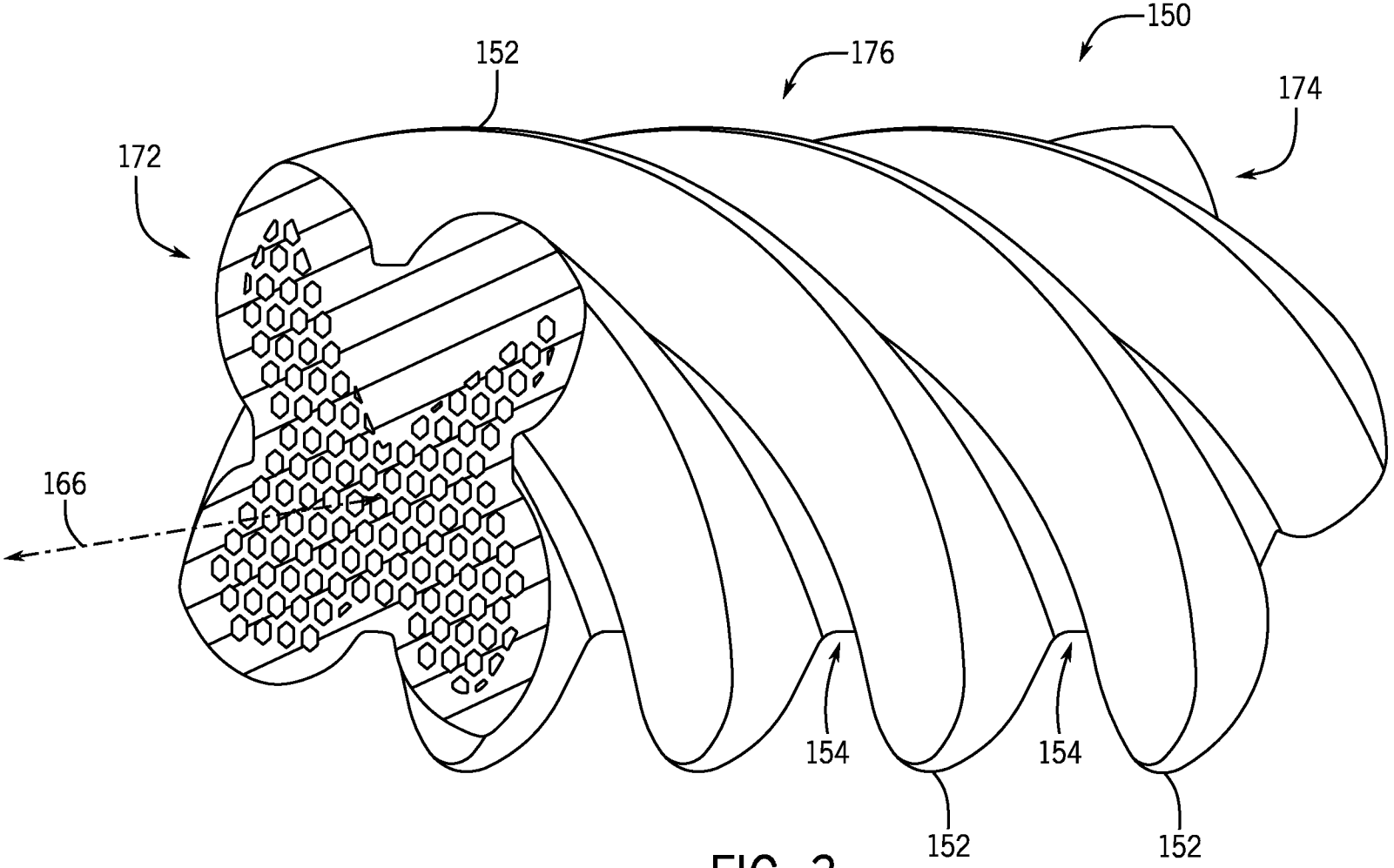
FIG. 3 is a perspective view of an embodiment of the second rotor of FIG. 2, in accordance with an aspect of the present disclosure.

FIG. 3 is a perspective view of the male rotor 150 further illustrating the ends 172 and 174 of the male rotor 150, as well as the threads 176. As shown in the illustrated embodiment of FIG. 3, the threads 176 of the male rotor 150 form spirals along the central axis 166 of the male rotor 150 from the first end 172 to the second end 174. As shown in the illustrated embodiment of FIG. 3, the male rotor 150 is a constant lead rotor, in that the helix lead and/or pitch of the threads 176 is substantially constant along the central axis 166 of the male rotor 150 from the first end 172 to the second end 174. However, in other embodiments, as discussed above, the helix lead and/or pitch of the threads 176 may change along the central axis 166 of the male rotor 150, such that the male rotor 150 is a variable lead rotor.

Figure 4:
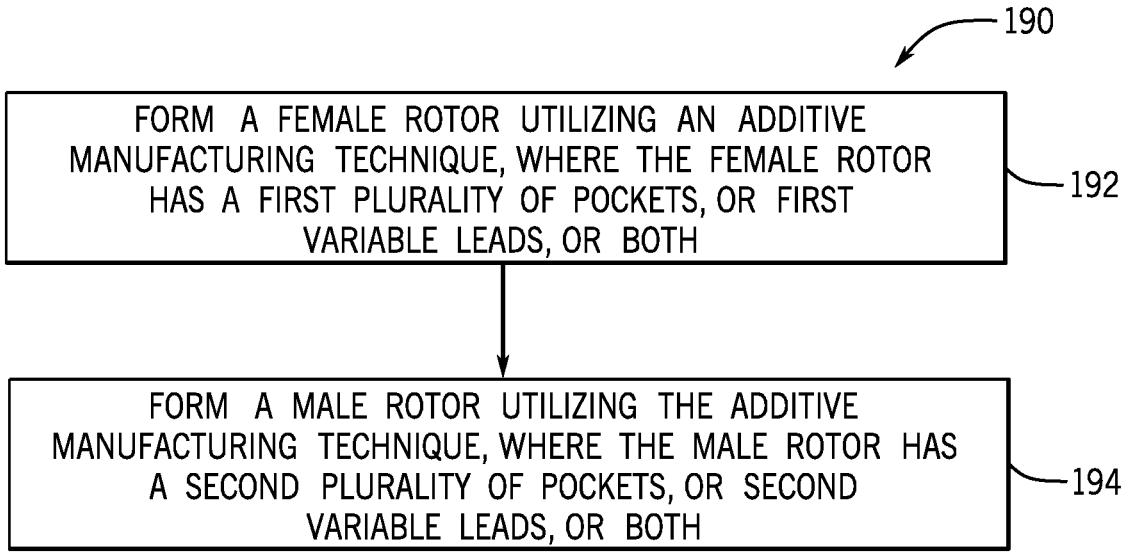
FIG. 4 is a block diagram of an embodiment of a method for manufacturing the first and second rotors of FIGS. 1-3, in accordance with an aspect of the present disclosure.

FIG. 4 is a block diagram of an embodiment of a process 190 that may be utilized to manufacture the female rotor 100 and/or the male rotor 150. For example, at block 192, the female rotor 100 is formed utilizing a additive manufacturing technique (e.g., 3-D printing and/or direct metal laser sintering (DMLS), laser-ultrasonic finishing, ultrasonic nanocrystal surface modification, selective laser sintering (SLS), selective laser melting (SLM), electronic beam melting (EBM), or a combination thereof). As discussed above, the female rotor 100 includes the plurality of pockets 108 and/or the variable lead threads 130. The additive manufacturing technique facilitates formation of the pockets 108 and the variable lead threads 130 because additive manufacturing techniques generally form a structure in a layer-by-layer process, instead of machining or processing a solid piece of material. As such, a mass of the female rotor 100 is reduced and transitions between helix lead and/or pitch changes in the variable lead threads 130 are reduced or eliminated when compared to existing rotors. While the mass of the female rotor 100 is reduced, a stiffness remains relatively high as a result of a configuration of the plurality of pockets 108 (e.g., pockets 108 near the flanks 114 are smaller than pockets 108 near the central axis 112). Further, the natural frequency of the female rotor 100 is increased when compared to existing rotors, such that the female rotor 100 generally includes an operating frequency that is below the natural frequency. Increasing the natural frequency reduces vibrations (e.g., when harmonics generated by an operating speed of the rotor approach lateral natural frequencies of the rotor), and thus, disruptions to the compressor as a result of vibrations. As discussed above, in some embodiments, the female rotor 100 may incur further processing and/or machining (e.g., grinding) after being formed via the additive manufacturing technique.

Additionally, at block 194, the male rotor 150 is formed utilizing the additive manufacturing technique (e.g., 3-D printing and/or direct metal laser sintering (DMLS), laser-ultrasonic finishing, ultrasonic nanocrystal surface modification, selective laser sintering (SLS), selective laser melting (SLM), electronic beam melting (EBM), or a combination thereof). As discussed above, the male rotor 150 includes the plurality of pockets 162 and/or the variable lead threads 176. The additive manufacturing technique facilitates formation of the pockets 162 and the variable lead threads 176 because additive manufacturing techniques generally form a structure in a layer-by-layer process, instead of machining or processing a solid piece of material. As such, a mass of the male rotor 150 is reduced and transitions between helix lead and/or pitch changes in the variable lead threads 176 are reduced or eliminated when compared to existing rotors. While the mass of the male rotor 150 is reduced, a stiffness remains relatively high as a result of a configuration of the plurality of pockets 162 (e.g., pockets 162 near the lobes 152 are smaller than pockets 162 near the central axis 166). Further, the natural frequency of the male rotor 150 is increased when compared to existing rotors, such that the male rotor 150 generally includes an operating frequency that is below the natural frequency. Increasing the natural frequency reduces vibrations (e.g., when harmonics generated by an operating speed of the rotor approach lateral natural frequencies of the rotor), and thus, disruptions to the compressor as a result of vibrations. In some embodiments, the male rotor 150 may incur further processing and/or machining (e.g., grinding) after being formed via the additive manufacturing technique.

As set forth above, embodiments of the rotors of the present disclosure may provide one or more technical effects useful in the operation of HVAC&R systems to improve a performance of a compressor. For example, embodiments of the present disclosure are directed to female and male rotors that are formed utilizing additive manufacturing techniques. The female and male rotors each include a plurality of pockets that reduce an overall mass of the rotors while maintaining a stiffness of the rotors. Reducing the mass of the rotors may increase a natural frequency of the rotors, which reduces and/or eliminates disruptions to compressor operation as a result of vibrations. Further still, the female and male rotors include variable lead threads that increase a compression rate of the compressor, and thus, further improve an efficiency of the compressor. Utilizing the additive manufacturing techniques may reduce and/or eliminate transitions between helix leads and/or pitches of the variable lead threads. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode, or those unrelated to enablement). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A system, comprising:

a compressor configured to compress a vapor, or a vapor and liquid mixture; and a first rotor of the compressor disposed on a first shaft, wherein the first rotor comprises a first plurality of closed pockets in a first body portion to form a first semi-hollow internal volume of the first rotor, wherein a first cross-sectional area of a first closed pocket of the first plurality of closed pockets is greater than a second cross-sectional area of a second closed pocket of the first plurality of closed pockets, and the second closed pocket is disposed radially outward from the first closed pocket relative to a central axis of the first rotor.

2. The system of claim 1, wherein the first plurality of closed pockets forms a honeycomb, webbed, or gyroid structure, and wherein the first plurality of closed pockets comprises gaps, voids, or spaces that do not include includes solid material.

3. The system of claim 1, comprising a second rotor of the compressor disposed on a second shaft, wherein the second rotor comprises a second plurality of pockets in a second body portion to form a second semi-hollow internal volume of the second rotor, wherein the first rotor and the second rotor are configured to mesh with one another to compress the vapor, or the vapor and liquid mixture, in the compressor as the first shaft rotates in a first circumferential direction and the second shaft rotates in a second circumferential direction, opposite the first circumferential direction.

4. The system of claim 3, wherein the first plurality of closed pockets, or the second plurality of pockets, or both, forms a honeycomb, webbed, or gyroid structure, wherein the first plurality of closed pockets and the second plurality of pockets comprise gaps, voids, or spaces that do not include solid material.

5. The system of claim 3, wherein the first rotor comprises a first resonance frequency that is greater than a first operating frequency of the first rotor, and wherein the second rotor comprises a second resonance frequency that is greater than a second operating frequency of the second rotor.

6. The system of claim 1, wherein the first plurality of closed pockets is formed in the first rotor to achieve a resonance frequency of the first rotor that is greater than an operating frequency of the first rotor.

7. The system of claim 1, wherein the first rotor and the first shaft are a single-piece, unitary structure.

8. The system of claim 1, wherein the first shaft is a first hollow shaft.

9. The system of claim 1, wherein the first rotor comprises a plurality of flanks and a plurality of flutes on an outer surface of the first rotor, and wherein a distance between adjacent flanks of the plurality of flanks and adjacent flutes of the plurality of flutes decreases along the central axis of the first rotor from a first end of the first rotor to a second end of the first rotor.

10. The system of claim 1, wherein the first rotor comprises a first central passageway extending along the central axis of the first rotor.

11. A system, comprising:

a compressor configured to compress a vapor, or a vapor and liquid mixture; and a first rotor of the compressor disposed on a first shaft, wherein the first rotor comprises a plurality of flanks and a plurality of flutes on a first external surface of the first rotor, wherein the plurality of flanks and the plurality of flutes comprise a first pitch to form first variable leads, wherein the first rotor comprises a first plurality of closed pockets in a first body portion to form a first semi-hollow internal volume of the first rotor, and wherein a first cross-sectional area of a first closed pocket of the first plurality of closed pockets is greater than a second cross-sectional area of a second closed pocket of the first plurality of closed pockets, and wherein the second closed pocket is disposed radially outward from the first closed pocket relative to a central axis of the first rotor.

12. The system of claim 11, comprising a second rotor of the compressor disposed on a second shaft, wherein the second rotor comprises a plurality of lobes on a second external surface of the second rotor, wherein the plurality of lobes comprises a second pitch to form second variable leads, and wherein the plurality of flanks and the plurality of flutes of the first rotor are configured to mesh with corresponding grooves of the second rotor at the first pitch and the plurality of lobes of the second rotor are configured to mesh with corresponding flutes of the plurality of flutes of the first rotor at the second pitch to compress the vapor, or the vapor and liquid mixture, in the compressor as the first shaft rotates in a first circumferential direction and the second shaft rotates in a second circumferential direction, opposite the first circumferential direction.

13. The system of claim 12, wherein the first pitch is configured to increase along the central axis of the first rotor from a first end of the first rotor to a second end of the first rotor, and wherein the second pitch is configured to increase along an additional central axis of the second rotor from a third end of the second rotor to a fourth end of the second rotor.

14. The system of claim 12, wherein the first rotor and the first shaft are a single-piece, unitary structure.

15. The system of claim 12, wherein the second rotor and the second shaft are a single-piece, unitary structure.

16. The system of claim 11, wherein the first rotor comprises a first end and a second end, and wherein the first pitch of the plurality of flanks and the plurality of flutes at the first end is different from a second pitch of the plurality of flanks and the plurality of flutes at the second end.

17. A method of manufacturing compressor rotors, comprising:

forming a first rotor using additive manufacturing, wherein the first rotor comprises a first plurality of closed pockets within a first body portion, or first variable leads, or both, wherein a first cross-sectional area of a first closed pocket of the first plurality of closed pockets is greater than a second cross-sectional area of a second closed pocket of the first plurality of closed pockets, and the second closed pocket is disposed radially outward from the first closed pocket relative to a central axis of the first rotor; and forming a second rotor using the additive manufacturing, wherein the second rotor comprises a second plurality of pockets within a second body portion, or second variable leads, or both.

18. The method of claim 17, wherein the additive manufacturing comprises three-dimensional printing, direct metal laser sintering (DMLS), laser-ultrasonic finishing, ultrasonic nanocrystal surface modification, selective laser sintering (SLS), selective laser melting (SLM), electronic beam melting (EBM), or a combination thereof.

19. The method of claim 17, wherein the first rotor comprises a plurality of flanks on a first external surface of the first rotor, and wherein the plurality of flanks comprises a first pitch to form first variable leads.

20. The method of claim 19, wherein the second rotor comprises a plurality of lobes on a second external surface of the second rotor, wherein the plurality of lobes comprises a second pitch to form second variable leads, and wherein the plurality of flanks of the first rotor are configured to mesh with corresponding grooves of the second rotor at the first pitch and the plurality of lobes of the second rotor are configured to mesh with corresponding flutes of the first rotor at the second pitch to compress a vapor, or a vapor and liquid mixture, in the compressor as the first shaft rotates in a first circumferential direction and the second shaft rotates in a second circumferential direction, opposite the first circumferential direction.

* * * * *